United States Patent [19]

Newsome

[11] Patent Number: 4,593,510

[45] Date of Patent: Jun. 10, 1986

[54] PRE-FABRICATED AND MODULAR CHIMNEY FACADE SYSTEM

[76] Inventor: R. Wayne Newsome, 13132 Williamfield Dr., Ellicott City, Md. 21043

[21] Appl. No.: 666,761

[22] Filed: Oct. 31, 1984

[51] Int. Cl.[4] ..... E04C 1/00

[52] U.S. Cl. ..... 52/314; 110/184; 126/120

[58] Field of Search ..... 52/218, 219, 311, 314, 52/107; 98/46, 58; 110/184; 126/120

[56] References Cited

U.S. PATENT DOCUMENTS

| | | | |
|---|---|---|---|
| 252,064 | 1/1882 | Terwilliger | 126/126 |
| 797,856 | 8/1905 | Keith | 52/218 |
| 3,089,521 | 5/1963 | Paiement | 52/314 |
| 3,278,742 | 10/1966 | Stallard | 52/219 |
| 3,464,174 | 9/1969 | Rosenberg | 52/218 |
| 3,809,051 | 5/1974 | Giroux | 126/126 |
| 4,180,052 | 12/1979 | Henderson | 126/126 |
| 4,259,941 | 4/1981 | Gerdes | 126/120 |

*Primary Examiner*—Henry E. Raduazo
*Assistant Examiner*—Dan W. Pedersen
*Attorney, Agent, or Firm*—Morton J. Rosenberg

[57] ABSTRACT

A pre-fabricated and modular chimney facade system (10) is provided for enclosing a chimney stack (12) passing therethrough. The chimney facade system (10) is adapted to be secured to an external wall (16) of a building structure (14). The chimney facade system includes a one-piece base housing (18) which is adapted to be mounted to a base foundation member (20) and to the external wall (16). The base housing (18) is vertically aligned with and coupled to a transition housing (44) which is fixedly secured to the external wall (16) of the building structure (14). Additional housing members are modularly coupled to the transition housing (44) to provide a complete enclosure for smoke stack (12). The housing (18, 44) as well as additional housing units (74, 102) and cap housing (120) are formed in one-piece formation and generally molded of a plastic composition. In this manner, there is provided a lightweight easily assembled chimney facade system (10).

34 Claims, 10 Drawing Figures

114
66
74
90
94
62
94
86
88
66
44
98
96
62
66

72
90
86
10
68
102
70
44
58
62
60
30
62
18
112
20
40
38

PRE-FABRICATED AND MODULAR CHIMNEY FACADE SYSTEM

BACKGROUND OF THE INVENTION

1. Field of the Invention

This invention pertains to chimney facade systems. In particular, this invention directs itself to pre-fabricated and modular chimney facade systems which may be assembled on-site of a construction project. Further, this invention directs itself to a chimney facade system comprising a plurality of one-piece housing units defining a through passage within which a chimney stack is located. Still further, this invention relates to a chimney facade system which allows for individual coupling of discrete housing units to provide a pre-fabricated/-modular type chimney facade structure.

2. Prior Art

Chimney facade systems are known in the art. However, pre-fabricated and modular chimney facade systems of the type herein described are not seen in the prior art. The best prior art known to the Applicant includes U.S. Pat. Nos. 3,538,656; 2,539,177; 3,425,178; 3,464,174; 3,466,000; 4,384,566; 3,460,525; 3,761,551; 3,874,364; and, 2,687,127.

Some prior art systems are directed to a pre-fabricated sectional element system for chimneys, as is shown in U.S. Pat. No. 3,538,656. Such chimney stacks consist of a multiplicity of one story high pre-fabricated sectional elements. However, such sectional elements provide for an outer jacket formed of a concrete composition with a reinforcing steel mat. Such prior art systems are formed of relatively heavy type material compositions and do not provide for a plastic material composition to provide weight saving and cost effectiveness.

In other prior art systems such as that shown in U.S. Pat. No. 2,539,177, there are provided prefabricated block flues having a plurality of blocks being provided depending upon the height of the overall building. However, such blocks are generally formed of a refractory or fireproof material, such as cement or firebrick clay. Such prior art systems do not provide for a material composition which allows for ease of varying the height and dimensions of the particular system on-site.

SUMMARY OF THE INVENTION

A pre-fabricated and modular chimney facade system for enclosing a chimney stack passing therethrough. The chimney facade system is adapted to be fixedly secured to an external wall of the building structure. The chimney facade system includes a one-piece base housing which is fixedly secured to a base foundation member and the external wall of the building structure. The base housing further defines a through passage having a first cross-sectional area greater than a cross-sectional area of the chimney stack. The chimney facade system further includes a one-piece transition housing which is fixedly secured to the one-piece base housing and the external wall of the building structure. The one-piece transition housing defines a transition through passage of diminishing cross-sectional area from a first section to a second section thereof. The transition housing first section opening being substantially equal to the base housing through opening.

One object of the subject chimney facade system is to provide a pre-fabricated and modular chimney facade system which allows on-site construction.

A further object of the subject chimney facade system is to provide a lightweight overall system which is formed of modular units and can be constructed on-site of a construction project by a minimum amount of workers.

A further object of the subject invention is to provide a one-piece molded chimney facade system which is formed of a plastic composition.

A still further object of the subject invention is to provide a chimney facade system formed of a minimum amount of one-piece molded units which are mounted each to the other with a maximization of ease of construction.

Another object of this invention is to provide a chimney facade system which is formed of a plurality of single piece units having a minimization of volume to increase the shipping cost effectiveness.

A still further object of this invention is to provide a chimney facade system which can easily be transportable to the site of construction.

A still further object of this invention is to provide a chimney facade system wherein entire sections may be carried by one person to the site of construction and then placed in proper alignment and coupling with a minimization of effort.

DESCRIPTION OF THE PREFERRED EMBODIMENTS

Figure 1:
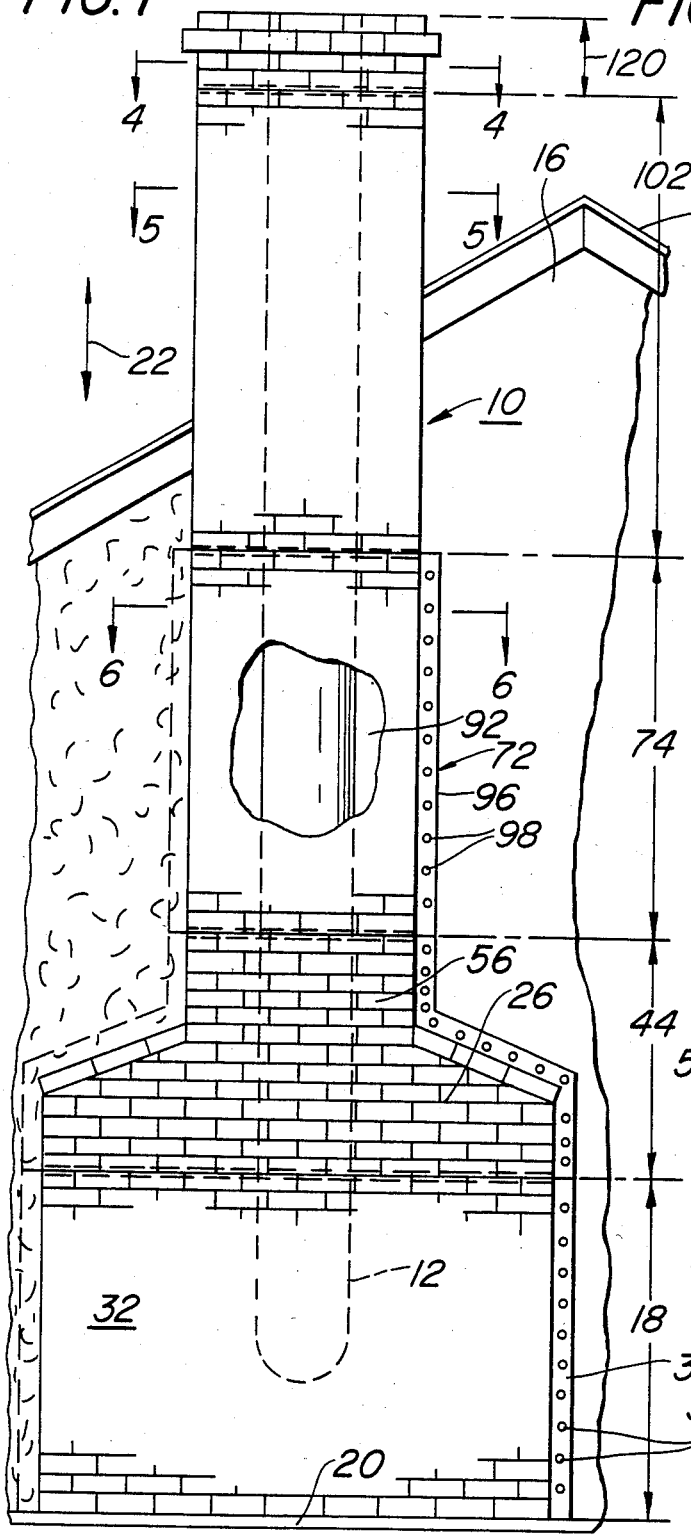
FIG. 1 is an elevational view partially cut-away of the chimney facade system.
Figure 2:
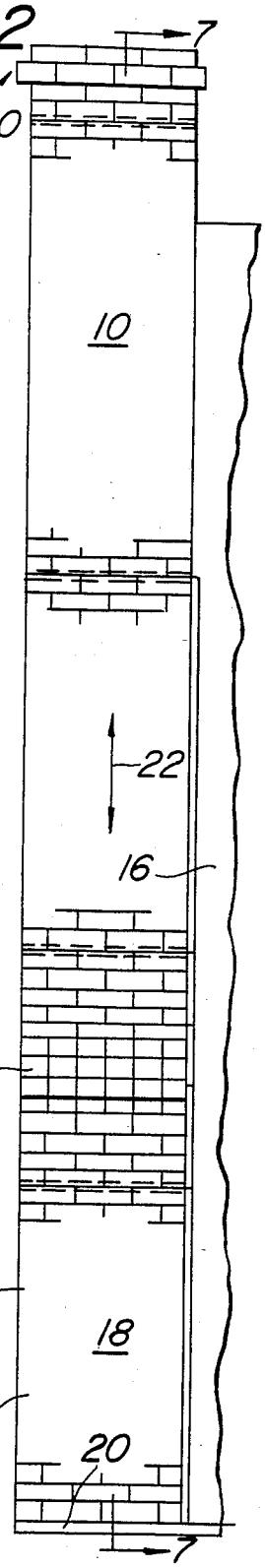
FIG. 2 is a side elevational view of the chimney facade system.
Figure 3:
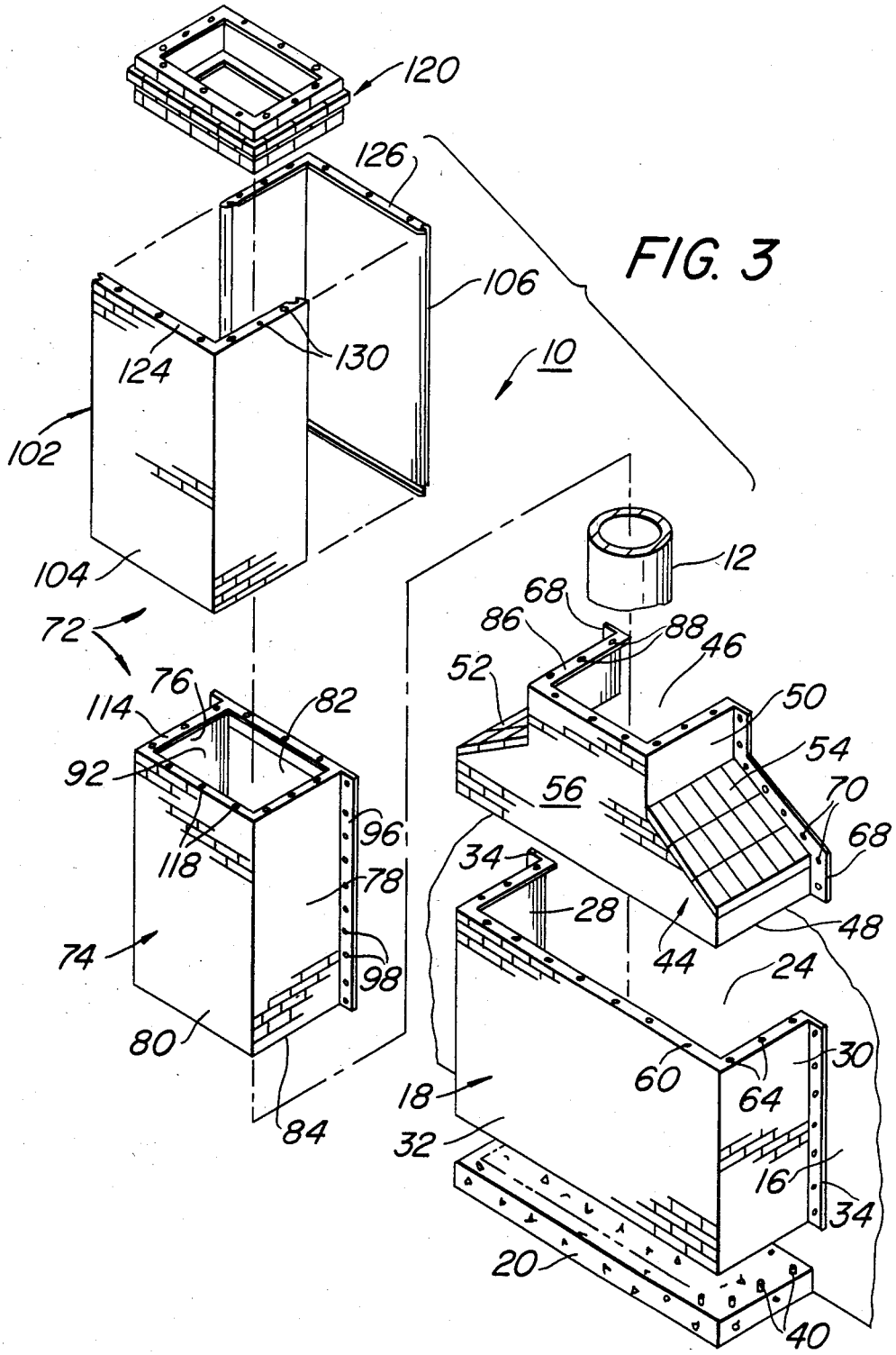
FIG. 3 is a perspective partially cut-away exploded view of the chimney facade system.

Referring now to FIGS. 1–3, there is shown prefabricated and modular chimney facade system 10 for enclosing chimney stack 12 passing therethrough. As can be seen, chimney facade system 10 is adapted to be fixedly secured to external wall 16 of building structure 14. In general, chimney facade system 10 may be utilized in connection with an internal fireplace or other heating mechanism used in commercial and/or domestic environments. Chimney facade system 10 is composed of a plurality of one-piece formed housings to be described in following paragraphs. Facade system 10 extends generally in vertical direction 22 and is easily mountable to building structure 14.

In prior art systems, various chimney facade systems have been utilized and formed out of varying structural materials, such as brick, wood, and other like construction compositions. Chimney facade system 10 of the subject invention concept provides for a modular system which is pre-fabricated off-site. Additionally, the lightweight characteristics of the particular fascade system composition allows for on-site placement by one person. Additionally, since facade system 10 is formed by a relatively small number of sectional housings, the volume is minimized for shipping and provides for easy transportability to the site of construction. Once at the construction site, entire sections may be carried by a singular person and installed in a minimal amount of time to decrease the labor costs. Additionally, since the housing sections or facade system 10 are formed by general molding techniques to provide a small number of overall construction pieces, the cost of materials is further minimized.

Chimney facade system 10 includes one-piece base housing 18 which is fixedly secured to base foundation member 20, as is clearly seen in FIGS. 1–3. Additionally, one-piece base housing 18 is further fixedly secured to external wall 16 of building structure 14. Base housing 18 defines through passage 24 passing in vertical direction 22, and having a first cross-sectional area greater than a cross-sectional area of chimney stack 12. Through passage 24, as is clearly seen in FIG. 3, is defined by the walls of base housing 18 in combination with external wall 16 of building structure 14. As in the case of all of the housings to be described in following paragraphs, base housing 18 may have a frontal face formed of a brick type visual aspect as is shown by element 26. Brick-like covering 26 is formed of the same materials as the remaining portions of base housing 18, and may be molded to provide the aesthetic appeal of a conventional brick-like visualization.

Chimney stack 12 may be formed of a conventional stainless steel metallic composition, and since air is a thermal insulator, temperatures on base housing 18 have been found to be minimal, even when a fireplace is being utilized with high temperatures found on the exterior surface of chimney stack 12.

Base housing 18 as can be seen in FIG. 3, is substantially U-shaped in contour and includes opposing base leg wall sections 28, 30 which are coupled in one-piece formation to base frontal wall section 32.

Chimney facade system 10 includes a mechanism for coupling base housing 18 to external wall 16 of building structure 14. As seen in FIGS. 1 and 3, there is provided base housing flange members 34 extending in vertical direction 22 throughout the vertical height of base housing 18. Base housing flange members 34 extend laterally and external to base housing 18 for interfacing with external wall 16 of building structure 14. Base housing flange members 34 may include vertically displaced openings 36 through which nails, bolts, or some like mechanism may be inserted to mount base housing 18 to external wall 16. In this way, base housing 18 may be fixedly secured to external wall 16.

Base housing 18 further includes a mechanism for coupling base housing 18 to base foundation member 20. Base housing 18 includes internal base housing flange member 38 shown in FIG. 7, which extends internal base through passage 24 and is fixedly secured to at least one of opposing base leg wall sections 28, 30 and/or base frontal wall section 32. Internal base housing flange member 38 interfaces with base foundation member 20 and is adapted to be fixedly secured thereto through foundation threaded bolts 40, or some like mechanism, not important to the inventive concept as herein described. In this manner, base housing 18 is seen to be fixedly secured to both base foundation member 20 and external wall 16.

Of extreme importance in the inventive concept of this invention is the fact that base housing 18 may be molded in one-piece formation. Thus, base housing 18 may be formed of a plastic closed-cell composition well-known in the art. Internal base housing flange member 38 and external base housing flange members 34 are formed generally of the same plastic composition and are formed in one-piece formation with wall sections 28, 30 and 32. In constructive operation, base housing 18 may be transported to the construction site and installed on previously formed base foundation member 20 and either nailed or bolted to external wall 16 of building structure 14 in a minimum labor time.

Figure 9:
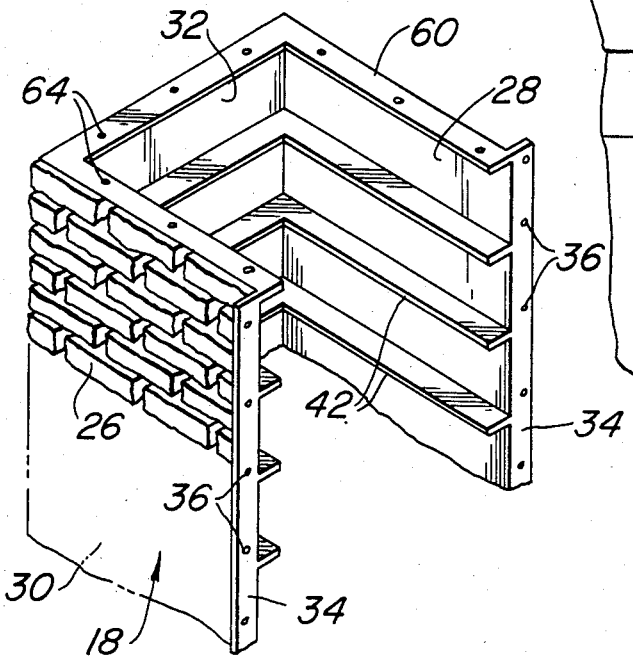

Base housing 18 further may include a plurality of base internal flange members 42, as is clearly seen in FIG. 9. Internal base housing flanges 42 are formed in one-piece formation with respect to base leg wall sections 28, 30, and frontal wall section 32. Internal base housing flanges 42 are displaced each from the other by a set amount in vertical direction 22. Base housing flanges 42 provide for a plurality of purposes and increase the rigidity of base housing 18 in one use. Additionally, it is clearly seen that since base housing 18 is formed of a plastic-like composition, flanges 42 may be utilized to vary the vertical height of base housing 18 dependent upon the particular building structure height. Thus, where it is of necessity to vary the vertical height of base housing 18 dependent upon a particular vertical height restriction imposed by building structure 14, base housing 18 may be cut in a horizontal plane along or adjacent to one of internal base housing flanges to provide an acceptable coupling as has hereinbefore been described.

Chimney facade system 10 further includes one-piece transition housing 44 which is fixedly secured to one-piece base housing 18 and external wall 16 of building structure 14. One-piece transition housing 44 defines transition through passage 46 of diminishing cross-sectional area from transition housing first or lower section 48 to second or upper section 50. The through opening in transition housing first or lower section 48 is substantially equal to base housing through opening or passage 24 in order to allow alignment between transition housing 44 and base housing 18. As can be seen, transition housing 44 is vertically aligned with base housing 18 to provide an overall through passage for chimney stack 12.

Transition housing 44 is substantially U-shaped in cross-sectional contour and includes opposing transition wall sections 52 and 54 in combination with transition frontal wall section 56.

Figures 7, 7A:
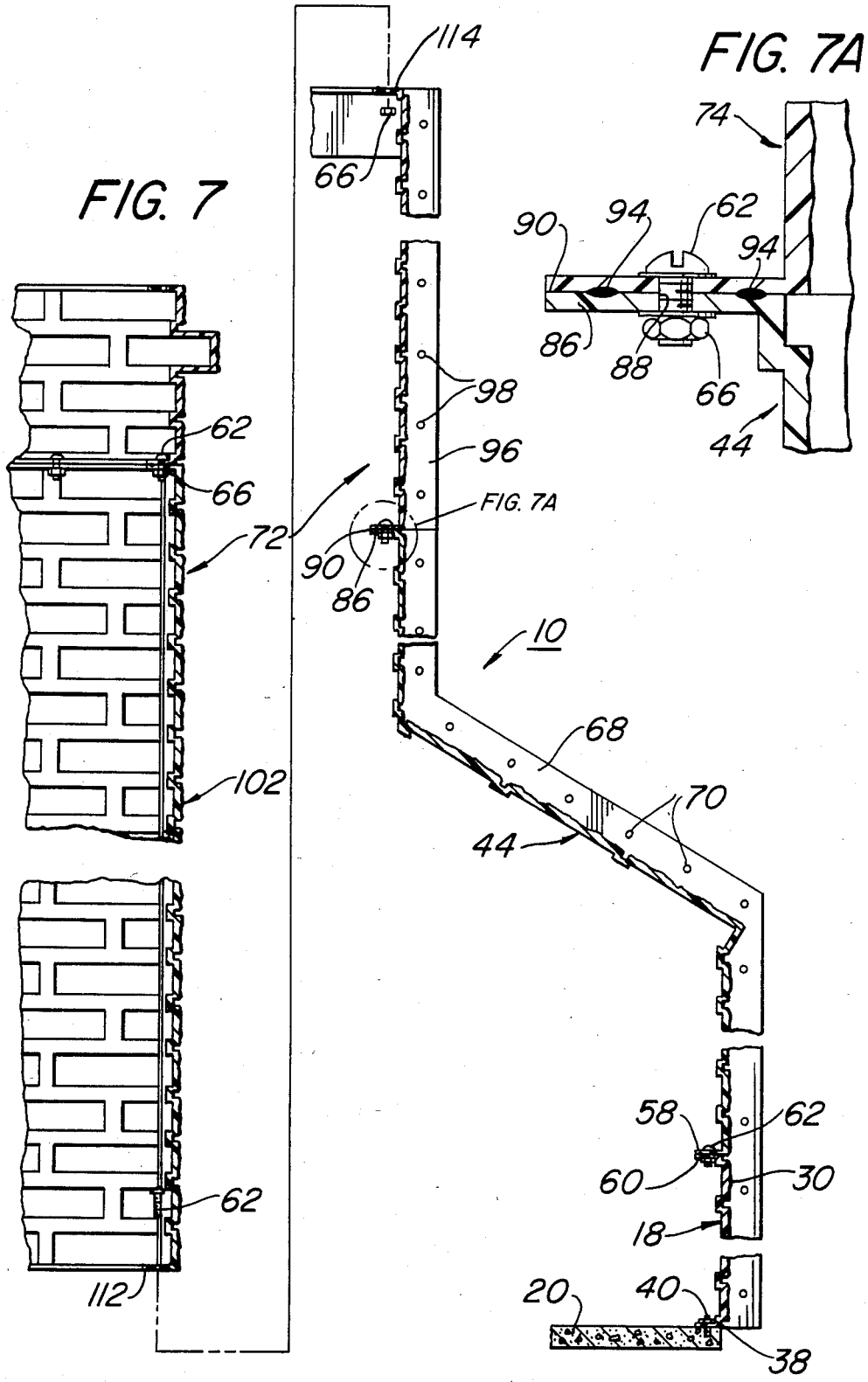
FIG. 7 is a sectional view of the chimney facade system partially cut-away taken along the Section Line 7—7 of FIG. 2.
FIG. 7A is an exploded view of a portion of FIG. 7.

Chimney facade system 10 further includes a mechanism for fixedly securing base housing 18 to transition housing 44. As is seen in FIG. 7, transition housing 44 includes internal lower transition flange 58 which is threadedly coupled to internal upper base housing flange member 60 shown in both FIGS. 7 and 3. Both upper and lower flanges 58 and 60 extend internal the through passages defined by opening 24 and are adapted to matingly interface each with respect to the other. Thus, like bolt member openings 64 formed through internal upper base housing flange 60 cooperate with similar openings formed through internal lower transition flange member 58 and are threadedly secured thereto through bolt members 62 as is seen in FIG. 7.

Transition housing 44 further includes a mechanism for fixedly securing transition housing 44 to external wall 16 of building structure 14. Transition housing 44 includes transition housing external flange member 68 shown in FIGS. 3, 7 and 1, and such is adapted for interfacing with external wall 16 and is adapted to be fixedly secured thereto through openings 70 formed in external flange member 68 through bolting, nailing, or some like technique. Transition housing external flange members 68 are formed in one-piece formation with opposing transition walls 52 and 54 to provide a one-piece unitary structure.

Transition housing 44 as in the case of base housing 18 may be molded in one-piece formation and may particularly be formed of a closed-cell plastic composition.

In this manner, transition housing 44 may be vertically aligned and mounted to base housing 18 by mere alignment of openings 64 on corresponding internal lower transition flange members 58 and internal upper base housing flange members 60. Both members 62 are inserted through the openings and transition housing 44 is secured to base housing 18 without any external visual effects shown by the bolting process. Additionally, by fixedly securing transition housing external flange members 68 to external walls 16 through nailing or bolting, transition housing 44 is additionally fixedly secured to external wall 16.

Chimney facade system 10 further includes upper housing 72 enclosing chimney stack 12. Upper housing 72 is coupled to one-piece transition housing 44 and may at least partially be secured to external wall 16 of building structure 14. Upper housing 72 defines upper housing through passage 74 having a cross-sectional area substantially equal to transition housing cross-sectional area opening 46. Upper housing 72 includes upper box housing member 74 formed in one-piece formation. First upper box housing member 74 includes opposingly displaced side walls 76 and 78, as well as frontal wall member 80 and rear wall member 82. First upper box housing member 74 includes lower end 84 which is adapted to be coupled to transition housing 44.

First upper box housing 74 includes a mechanism for coupling housing 74 to transition housing 44. As is seen in FIG. 3, transition housing 44 includes upper internal transition housing flange 86 extending internal through passage 44 and formed at an upper end of transition housing 44. As can be seen, upper internal transition housing flange 86 includes a plurality of openings 88 which align with openings formed in lower box housing flange 90, more clearly seen in FIG. 7. First upper box housing lower end 84 carries in one-piece formation upper box housing flange 90 extending internal through passage 92. As seen in FIG. 7A, upper box flange 90 is secured to upper transition flange 86 by bolt 62 passing through cooperating openings 88 and being joined together with flange nut 66. Additionally, glue or other adhesive may be inserted into areas 94 to increase the coupling of one housing member with respect to another. Upper box housing flange 90 is coupled in one-piece formation to sidewalls 76, 78, as well as frontal wall 80 and rear wall 82, to provide a flange which substantially passes throughout the periphery of the cross-sectional area of first upper box housing member 74.

First upper box housing member 74 is further coupled to external wall 16 through upper box flange extensions 96 having openings 98 formed therethrough in order to nail, bolt, or otherwise secure first upper box housing member 74 to external walls 16. Flange member 96 of first upper box housing member 74 may be formed of the same material as walls 76, 78, 80 and 82. Additionally, flange members 96 extend external to the overall contour of first upper box housing member 74 and is formed in one-piece formation therewith.

Figure 6:
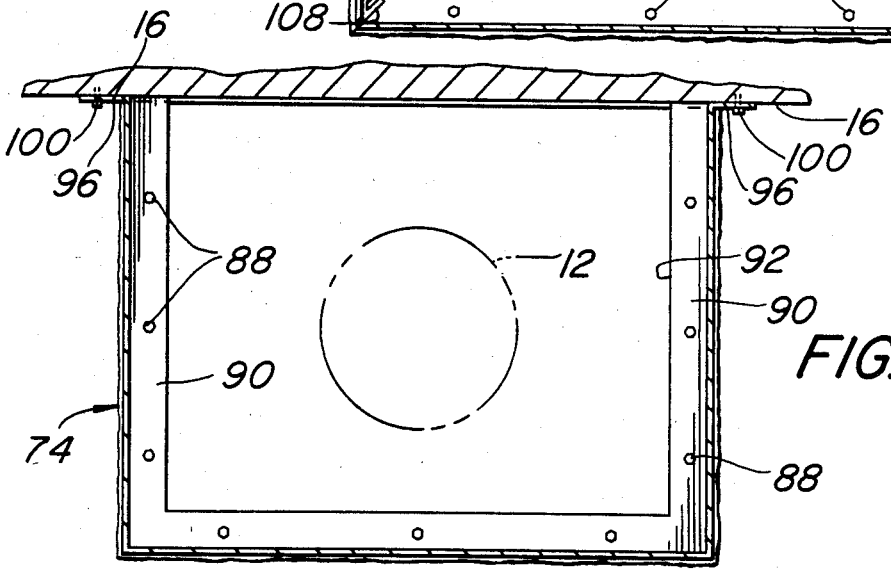
FIG. 6 is a sectional view of a portion of the chimney facade system taken along the Section Line 6—6 of FIG. 1.

As has been seen for base housing 18 and transition housing 44, first upper box housing member 74 may be molded in one-piece formation and formed of a closed-cell plastic composition. As can be seen in FIG. 6, nail members 100 may be used to secure first upper box housing member 74 to external wall 16.

Figure 5:
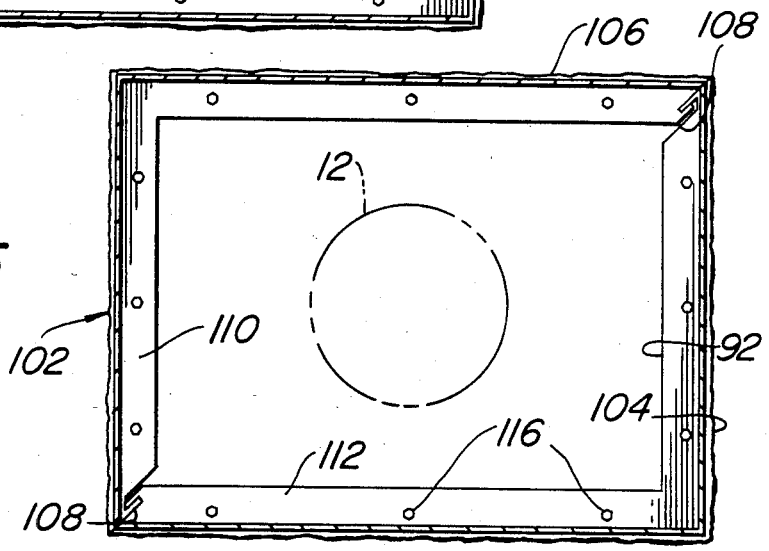
FIG. 5 is a sectional view of a portion of the chimney facade system taken along the Section Line 5—5 of FIG. 1.

Upper housing 72 further includes second upper box housing 102 which is fixedly secured to first upper box housing member 74 at a lower end thereof. Second upper box housing 102 is formed of a pair of L-shaped cross-sectional contour members 104, 106 which in combination, form a cross-sectionally closed contour as is seen in FIG. 5. Second upper box housing 102 is in substantial vertical alignment with first upper box housing member 74 to form continued through passage 92 having chimney stack 12 contained therein, as is further seen in FIG. 5.

Referring now to FIG. 5, it is clearly seen that L-shaped contour members 104, 106 may be secured each to the other through a tongue in groove insert coupling 108. The tongue in groove 108 may then be adhesively secured each to the other, or bolted, or otherwise secured to form the substantially closed contour cross-sectional envelope as shown in FIG. 5. Second upper box housing 102 further includes second upper box housing internal flange elements 110 and 112 formed in one-piece formation with respective L-shaped wall members 106 and 104. Internal flanges 110 and 112 are vertically aligned with first upper box housing member upper flange 114 and provide for securement by bolting or otherwise mechanical securement between openings 116 and openings 118 formed through first upper box flange 114.

Each of L-shaped wall members 104 and 106 may be formed in one-piece formation and molded of a plastic-like material, similar to that previously described for other sections of chimney facade system 10.

Figure 4:
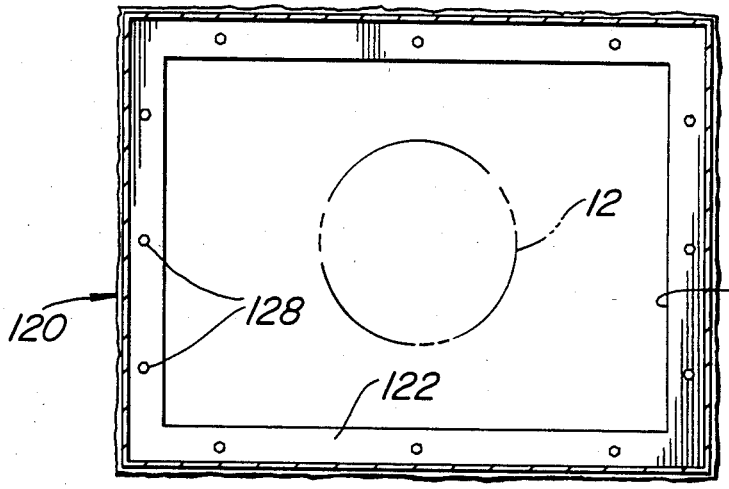
FIG. 4 is a sectional view of a portion of the chimney facade system taken along the Section Line 4—4 of FIG. 1.

Upper housing 72 further includes cap housing 120 which is fixedly secured to second upper box housing member 102 through bolted coupling of cap lower flange member 122 to L-shaped contour member flanges 124 and 126 shown in FIG. 3 in the manner previously described for coupling other sections of chimney facade system 10. As seen in FIG. 4, chimney stack 12 is vertically oriented within cap housing 120 and there is formed continuous through passage 92, as has previously been described. Flange openings 128 of cap housing 120 are aligned with openings 130 formed through L-shaped flanges 124 and 126 to provide securement of cap housing 120 to second upper box housing 102. Secured coupling as seen in FIG. 7 may be accomplished in the manner shown in FIG. 7A through use of bolt member 62 being threaded to nut member 66.

Figure 8:
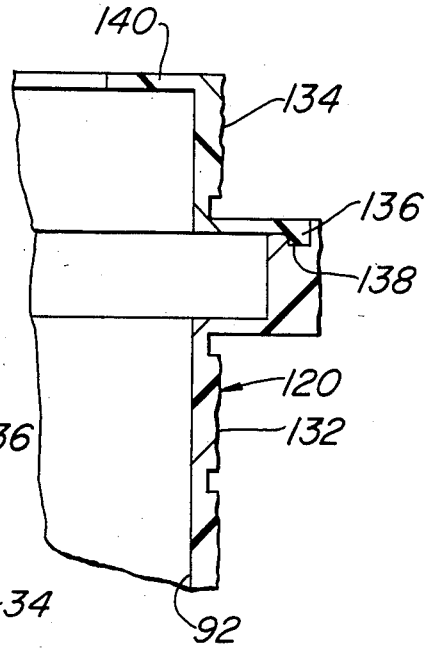
FIG. 8 is a sectional view of a portion of a cap housing of the chimney facade system showing the coupling of an upper cap housing member to a lower cap housing member; and, FIG. 9 is a perspective view of a base housing structure partially cut-away of the chimney facade system.

Cap housing 120 may be formed of lower cap housing member 132 and upper cap housing member 134, which are snap-fitted by cap tongue 136 being inserted within groove 138 shown in FIG. 8. Tongue element 136 may be snap-fitted within groove 138 to provide the overall contour and general aesthetic effect of an upper chimney section as is commonly recognized. Lower cap member 132 and upper cap member 134 each may be formed in one-piece formation and may be molded from a plastic composition such as that previously described for other sections of chimney facade system 10.

Upper cap member 134 may include upper cap member flange 140 passing internal to through passage 92 in the event that other sectional elements need be mounted thereon.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirt or scope of the invention as defined in the appended claims.

What is claimed is:

1. A pre-fabricated and modular chimney facade system for enclosing a chimney stack passing therethrough, said chimney facade system being adapted to be fixedly secured to an external wall of a building structure comprising:

(a) a one-piece base housing fixedly secured to a base foundation member positionally located external and adjacent said building structure and directly secured to an external surface of said external wall of said building structure, said base housing defining a through passage having a first cross-sectional area greater than a cross-sectional area of said chimney stack; and, (b) a one-piece transition housing removeably mountable and fixedly securable to said one-piece base housing and said external wall of said building structure, said one-piece transition housing defining a transition through passage of diminishing cross-sectional area from a first section to a second section thereof, said transition housing first section opening being substantially equal to said base housing through opening cross-sectional area and said transition housing second section opening having a cross-sectional area greater than said cross-sectional area of said chimney stack.

2. The chimney facade system as recited in claim 1 where said base housing is substantially U-shaped in contour having opposing base leg wall sections coupled in one-piece formation to a base frontal wall section.

3. The chimney facade system as recited in claim 2 where said base housing includes means for coupling said base housing to said external wall of said building structure.

4. The chimney facade system as recited in claim 3 where said means for coupling said base housing to said external wall includes at least one external base housing flange member extending external said base housing for interfacing with said external wall of said building structure and adapted to be fixedly secured thereto.

5. The chimney facade system as recited in claim 2 where said base housing includes means for coupling said base housing to said base foundation member.

6. The chimney facade system as recited in claim 5 where said means for coupling said base housing to said base foundation member includes at least one internal base housing flange member extending internal said base housing through passage and fixedly secured to at least one of said opposing base leg wall sections and said base frontal wall section, said internal base housing flange member for interfacing with said base foundation member and adapted to be fixedly secured thereto.

7. The chimney facade system as recited in claim 2 where said base housing includes at least one base internal flange member secured to an inner surface of said base leg wall sections and said base frontal wall section for increasing rigidity of said base housing.

8. The chimney facade system as recited in claim 2 where said base housing is molded in one-piece formation.

9. The chimney facade system as recited in claim 8 where said base housing is formed of a plastic composition.

10. The chimney facade system as recited in claim 2 where said transition housing is substantially U-shaped in cross-sectional contour having opposing transition wall sections and a transition frontal wall section, said transition housing having opposing upper and lower ends.

11. The chimney facade system as recited in claim 10 including means for fixedly securing said base housing to said transition housing in through passage alignment.

12. The chimney facade system as recited in claim 11 where said means for fixedly securing said base housing to said transition housing includes:

(a) an internal lower transition flange secured to said transition housing on said transition housing lower end; and, (b) an internal upper base housing flange secured to said base housing on an upper end thereof, said upper and lower flanges extending internal said through passages and adapted to matingly interface each with respect the other.

13. The chimney facade system as recited in claim 10 including means for coupling said transition housing to said external wall of said building structure.

14. The chimney facade system as recited in claim 13 where said means for coupling said transition housing to said external wall includes at least one external transition housing flange member extending external said transition housing for interfacing with said external wall of said building structure and adapted to be fixedly secured thereto.

15. The chimney system as recited in claim 10 where said transition housing is molded in one-piece formation.

16. The chimney system as recited in claim 15 where said transition housing is formed of a plastic composition.

17. The chimney facade system as recited in claim 1 including upper housing means for enclosing said chimney stack, said upper housing means being coupled to said one-piece transition housing and at least partially secured to said external wall of said building structure, said upper housing means defining an upper housing through passage having a cross-sectional area substantially equal to said transition housing second section cross-sectional area opening.

18. The chimney facade system as recited in claim 17 where said upper housing means includes a first upper box housing member formed in one-piece formation, said first upper box housing member including a pair of opposingly displaced sidewalls, a frontal wall member and a rear wall member, said first upper box housing member having a lower end adapted to be coupled to said transition housing.

19. The chimney facade system as recited in claim 18 where said first upper box housing member includes means for coupling said first upper box housing member to said transition housing.

20. The chimney facade system as recited in claim 19 where said transition housing includes an upper internal transition housing flange extending internal said through passage and formed at an upper end of said transition housing.

21. The chimney facade system as recited in claim 20 where said means for coupling said first upper box housing member to said transition housing includes an internal upper box housing flange extending internal said through passage and secured to said upper box housing displaced sidewalls, frontal wall and rear wall member at said lower end of said first upper box housing member, said internal upper box housing flange adapted to be fixedly secured to said upper internal transition housing flange.

22. The chimney facade system as recited in claim 21 including means for fixedly securing said first upper box housing member to said external wall of said building structure.

23. The chimney facade system as recited in claim 22 where said means for fixedly securing said first upper box housing member to said external wall of said building structure includes at least one external upper box housing flange coupled to said rear wall member, said external upper box housing flange being adapted to be secured to said external wall of said building structure.

24. The chimney facade system as recited in claim 18 where said first upper box housing member is molded in one-piece formation.

25. The chimney facade system as recited in claim 24 where said first upper box housing means is formed of a plastic composition.

26. The chimney facade system as recited in claim 18 where said upper housing means includes a second upper box housing member fixedly secured to said first upper box housing member at a lower end thereof.

27. The chimney facade system as recited in claim 26 where said second upper box housing member is formed from a pair of L-shaped cross-sectional contour members secured each to the other in a manner to form a cross-sectionally closed contour, said second upper box housing member having a through passage aligned with a through passage formed in said first upper box housing member.

28. The chimney facade system as recited in claim 27 where said pair of L-shaped contour members are secured each to the other by a tongue in groove securement.

29. The chimney facade system as recited in claim 27 where said second upper box housing member is fixedly secured to said first upper box housing member.

30. The chimney facade system as recited in claim 27 where each of said L-shaped cross-sectional contour members is molded in one-piece formation.

31. The chimney facade system as recited in claim 30 where each of said L-shaped cross-sectional contour members is formed of a plastic composition.

32. The chimney facade system as recited in claim 26 where said upper housing means includes a cap member fixedly secured to said second upper box housing member, said cap member having a through passage alignable with said second upper box housing through passage.

33. The chimney facade system as recited in claim 32 where said cap member is molded in one-piece formation.

34. The chimney facade system as recited in claim 33 where said cap member is formed of a plastic composition.

* * * * *